US009901769B2

(12) United States Patent
Fukuta et al.

(10) Patent No.: US 9,901,769 B2
(45) Date of Patent: Feb. 27, 2018

(54) PLURAL PARALLEL CUFF FOR MUSCLE TRAINING BY PRESSURIZING LIMB

(71) Applicant: Hiroji Fukuta, Kasugai-shi, Aichi (JP)

(72) Inventors: Hiroji Fukuta, Kasugai (JP); Yoshihisa Yamazaki, Shiki (JP)

(73) Assignee: Hiroji Fukuta, Kasugai-shi, Aichi (JP)

( * ) Notice: Subject to any disclaimer, the term of this patent is extended or adjusted under 35 U.S.C. 154(b) by 0 days.

(21) Appl. No.: 14/680,797

(22) Filed: Apr. 7, 2015

(65) Prior Publication Data

US 2015/0297933 A1 Oct. 22, 2015

(30) Foreign Application Priority Data

Apr. 16, 2014 (JP) ..... 2014-084474
Dec. 5, 2014 (JP) ..... 2014-247150

(51) Int. Cl.
*A63B 21/00* (2006.01)
*A63B 21/008* (2006.01)
*A63B 23/035* (2006.01)

(52) U.S. Cl.
CPC ..... *A63B 21/0085* (2013.01); *A63B 21/4011* (2015.10); *A63B 23/0355* (2013.01); *A63B 2208/053* (2013.01); *A63B 2225/62* (2013.01)

(58) Field of Classification Search
CPC ..... A63B 21/0085; A63B 2208/053; A61F 5/012; A61F 5/02233; A61F 5/055; A61F 5/334
See application file for complete search history.

(56) References Cited

U.S. PATENT DOCUMENTS 5,218,967 A * 6/1993 Shinomiya ..... A61B 5/02208 600/493
8,313,450 B2 * 11/2012 Ben-Nun ..... A61F 13/00987 601/151
2003/0120192 A1 * 6/2003 Chao ..... A61F 5/01 602/36
2011/0160022 A1 * 6/2011 Sato ..... A61H 9/0078 482/113
2012/0259260 A1 * 10/2012 Bard ..... A61F 5/05816 602/32

FOREIGN PATENT DOCUMENTS

JP 2670421 B 7/1997
JP 2796276 B 6/1998

* cited by examiner

*Primary Examiner* — Loan H Thanh
*Assistant Examiner* — Jennifer M Deichl
(74) *Attorney, Agent, or Firm* — patenttm.us

(57) ABSTRACT

A plural parallel cuff for muscle training is made to reinforce muscles of limbs while it is wound broad around the portion of an upper arm and/or a thigh with uniform and stable binding force for the light exercise training. Three cloth sleeve bags are sewn to a connection cloth spaced in parallel. Three short rubber bags are inserted into three cloth sleeve bags respectively. The rubber bags are connected each other with T-joints for air channel. A plug and a socket are used to connect the pneumatic pump detachably to the thin tube. The plural parallel cuff is wound around a limb and hook-and-loop fasteners are used to form loops by uniting both ends of each of the cloth sleeve bags. The rubber bags are inflated by a pneumatic pump for restricting the bloodstream and then an low intensity exercise is performed.

6 Claims, 6 Drawing Sheets

PLURAL PARALLEL CUFF FOR MUSCLE TRAINING BY PRESSURIZING LIMB

FIELD OF THE INVENTION

The present invention relates to a training tool for pressurizing limb in order to reinforce the muscle of the limb. More particularly, the present invention relates to a plural parallel cuff formed of about three cuffs arranged in parallel. The plural parallel cuff restricts bloodstream when it is wound around a limb portion, which is a compartment for the brachial region between the shoulder and the elbow joint, and the femoral region between the hip joint and the knee joint. In the training method of pressurizing limb portion, a low intensity exercise is performed while the plural parallel cuff pressurizes limb portion broadly and uniformly by pneumatically-inflated cuffs.

BACKGROUND OF THE INVENTION

The conventional method for training muscular strength is known well as disclosed in the following patent document 1. In this training method, a load is applied to the muscle for causing fatigue in the muscle. A fastening belt is wound around the desired muscles at the proximal part close to the heart. The circumference of this fastening belt is shortened by pulling the belt end for tightening the limb. Thereby, venous return is restricted.

And also, another conventional method for training muscular strength is known well as disclosed in the following patent document 2. In this training method, an exercise is performed while the venous return is restricted by an inflatable pneumatic cuff. This inflatable cuff is comprised of a rubber tube and a baffle plate provided along the outside of the tube in the cuff. This cuff is wound around the desired muscle at the part close to the heart for fastening the limb. In this state, air is compressed into the tube until the pressure reaches the desired value. Thus, an accurate compression force can be applied to the muscle.

PRIOR ART DOCUMENTS

Patent Documents

[Patent document 1] JP2670421B
[Patent document 2] JP2796276B

BRIEF DESCRIPTION OF THE INVENTION

Problem to be Solved by the Invention

In the conventional muscular training method, a fastening cuff is wound around the limb muscle at the part close to the heart for concentrating the pressure on this part in order to restrict venous return. An exercise is performed under this condition.

The fastening cuff for such conventional muscle training method is a belt-like single narrow fastening band. The length of the fastening cuff is designed as to cover almost all the circumference of a limb. Therefore, the user might feel pain when the fastening cuff binds the muscle tight enough to restrict venous return.

The lateral femoral cutaneous nerve, the sciatic nerve, the posterior femoral cutaneous nerve, the obturator nerve and so on pass at the part near the crotch of the thigh, especially, the lateral femoral cutaneous nerve exists the near epidermis of front thigh, as shown in the sectional view of FIG. 5.

And, the musculocutaneous nerve, the median nerve, the medial cutaneous nerve of forearm, the medial cutaneous nerve of arm, the ulnar nerve, the radial nerve and so on pass near the axilla of a brachium. Especially, a medial antebrachial cutaneous nerve exists near the inside epidermis, as shown in the sectional view of FIG. 5.

The rubber bag is wound on entire circumference of a portion of the thigh near the hip joint or the upper arm near the axilla. Then the portion is pressurized by the rubber bag with compressed air. Under this condition, the trainee can exercise only a short time, because a lateral femoral cutaneous nerve or a medial cutaneous nerve of forearm is constricted and the trainee feels gradually a pain.

The muscular training method with application of the plural parallel cuff of this invention is based upon the different principle from such conventional muscle training method.

When a muscle is activated, the brain emits a command and the command is transmitted through motor nerves to muscle fibers. These muscle fibers are generally categorized into two kinds of fibers, a slow twitch fiber and a fast twitch fiber. What we call a motor unit is a set of a motor nerve and a group of muscle fibers under its control. The motor nerves consist of two kinds of motor units. One is to control slow twitch fibers. Another is to control fast twitch fibers. The light-load training activates slow twitch fibers of small motor units. When those fibers get exhaustion and inactive, fast twitch fibers of large motor units begin to work. Fast twitch fibers are employed for drawing instantaneous power because of their quick contraction. Slow twitch fibers are employed for muscular endurance because of their slow contraction. Fast twitch fibers can work even in the anoxia state, but slow twitch fibers need oxygen for work.

Not all motor units in a muscle are activated in a training. Number and kind of working motor units vary according to a situation. In a light-load training, slow twitch fibers of small motor units begin to work at first. When they get exhaustion and stop working, fast twitch fibers of large motor units begin activity. In order to make fast twitch fibers active from the start, a heavy load (65% or more of the repetition maximum) must be applied. This is called the principle of size.

However, when muscles are pressed widely, the pressure in muscles goes up and the bloodstream in muscles is limited as in case of compartment syndrome. If light-load training is performed under this condition, at first slow twitch fibers begin activity according to the principle of size. But, limiting the bloodstream in muscles, the aerobic activity of slow twitch fibers reduces the supply of oxygen-abundant blood (arterial blood). Then the inside of muscles lapses fast into a hypoxia (or anoxia) state. As a result, it stops the activity of slow twitch fibers indispensable of oxygen. Instead, it begins the activity of fast twitch fibers unnecessary of oxygen.

In order to develop muscles, the muscles are required to work hard. When the training is performed with muscles compressed widely, even a light load can easily activate fast twitch fibers against the principle of size. On the other hand, the usual light-load training can hardly activate fast twitch fibers. Conversely, it is noticed that fast twitch fibers may be atrophied particularly for aged people.

The anaerobic activity of fast twitch fibers generates in muscles metabolic products of lactic acid and so on. Since the bloodstream is limited, those metabolic products are accumulated in muscles and the inside of muscles becomes in an inferior state. The brain detects it and secretion of physiologically-active substances, such as growth hormone, is promoted. This also promotes muscular development.

Whole muscle is pressed for restricting the bloodstream. Therefore, the bloodstream in muscles can be restricted early and surely, much more than restricting the bloodstream by pressing the muscular portion close to the heart. Then, training can be finished in a short time.

In this muscular power training method, a cuff must be rolled tight and broad around the muscle of the brachial region and/or the femoral region. But the upper arm and the thigh do not have fixed diameter like a column and the diameter differs at each region. When a wide cuff is rolled around a muscle tight, compression force concentrates on the portion of large diameter. Uniform compression force cannot be made to act along the muscle.

Therefore, the plural parallel cuff of this invention is made. Wide plural parallel cuff can be used for training method of low intensity exercise. The plural parallel cuff provides uniform compression force acting on a muscle when the pneumatically-inflated cuffs are wound broad around the muscle of the brachial region and/or the femoral region as described above.

Means to Solve the Problem

The plural parallel cuff of this invention is constituted as follows. Plural cloth sleeve bags are connected in parallel at spaced intervals from one another by a connection cloth. A rubber bag shorter than the cloth sleeve bag is inserted into the cloth sleeve bag. Hook-and-loop fasteners form loop cuffs by uniting the both ends of each cloth sleeve bag each other. A plug connects a pneumatic pump detachably to the channel tube that connects all the rubber bags to each other.

Advantages of the Invention

In the training of light exercise performed while the plural parallel cuff is wound widely around a portion of a muscle of an upper arm and/or a thigh with uniform compression force, the plural parallel cuff of this invention has the following advantages. The fast twitch fibers can get hypertrophy and muscular power can be reinforced. Furthermore, secretion of physiologically active substances, such as growth hormone, is promoted as the metabolic product of lactic acid or so is stored up into muscles.

PREFERRED EMBODIMENT OF THE INVENTION

The First Embodiment

Figure 1:
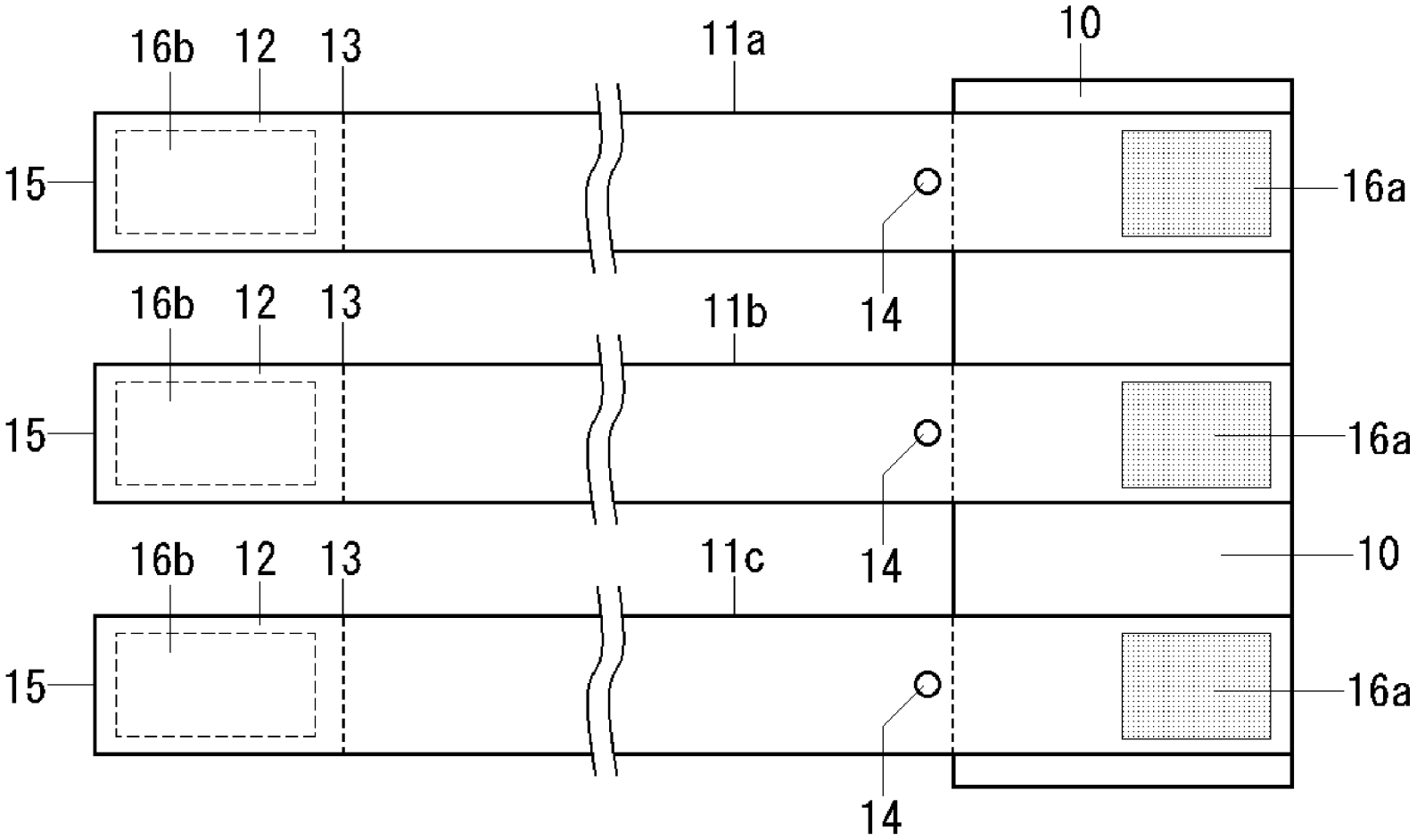
FIG. 1 is a plan view of three cloth sleeve bags sewn on the connection cloth for constituting the plural parallel cuff of this invention.
Figure 2:
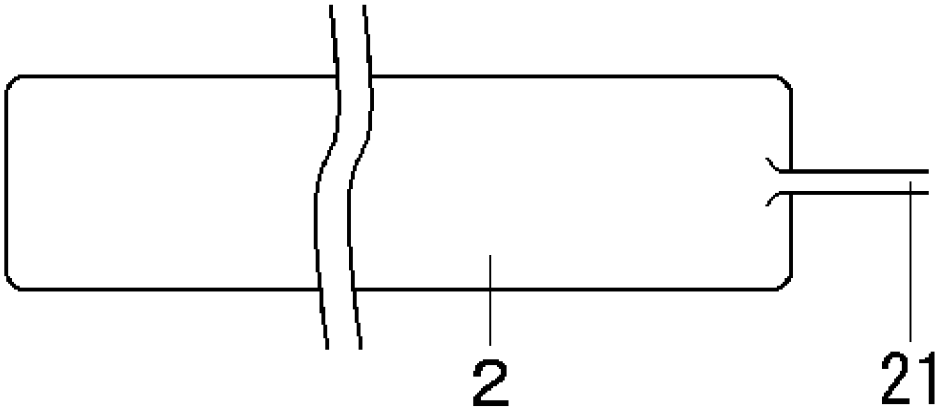
FIG. 2 is a plan view of a rubber bag for inserting into each of three cloth sleeve bags.

As shown in the plan views of FIGS. 1 and 2, the plural parallel cuff 1 of this invention for using the muscle training method has three thin cloth sleeve bags 11*a*, 11*b*, 11*c* and three thin rubber bags 2 for inserting into the cloth sleeve bags 11*a*, 11*b* and 11*c*, respectively.

Three cloth sleeve bags 11*a*, 11*b*, 11*c* are arranged in parallel at spaced intervals from one another. One end of each of three cloth sleeve bags 11*a*, 11*b*, 11*c* is sewn to the connection cloth 10 at spaced intervals. Each of these three cloth sleeve bags 11*a*, 11*b*, 11*c* has a small hole 14 near the seam where each pipe is sewn onto the connection cloth 10. The other end 15 of the cloth pipe is open.

As shown in the plan view of FIG. 2, each of three rubber bags 2 has a thin tube 21 for in and out of the air at one end. The other end of it is closed. A rubber bag 2 is inserted into each of three cloth sleeve bags 11*a*, 11*b*, 11*c* through the open end 15.

Figure 3:
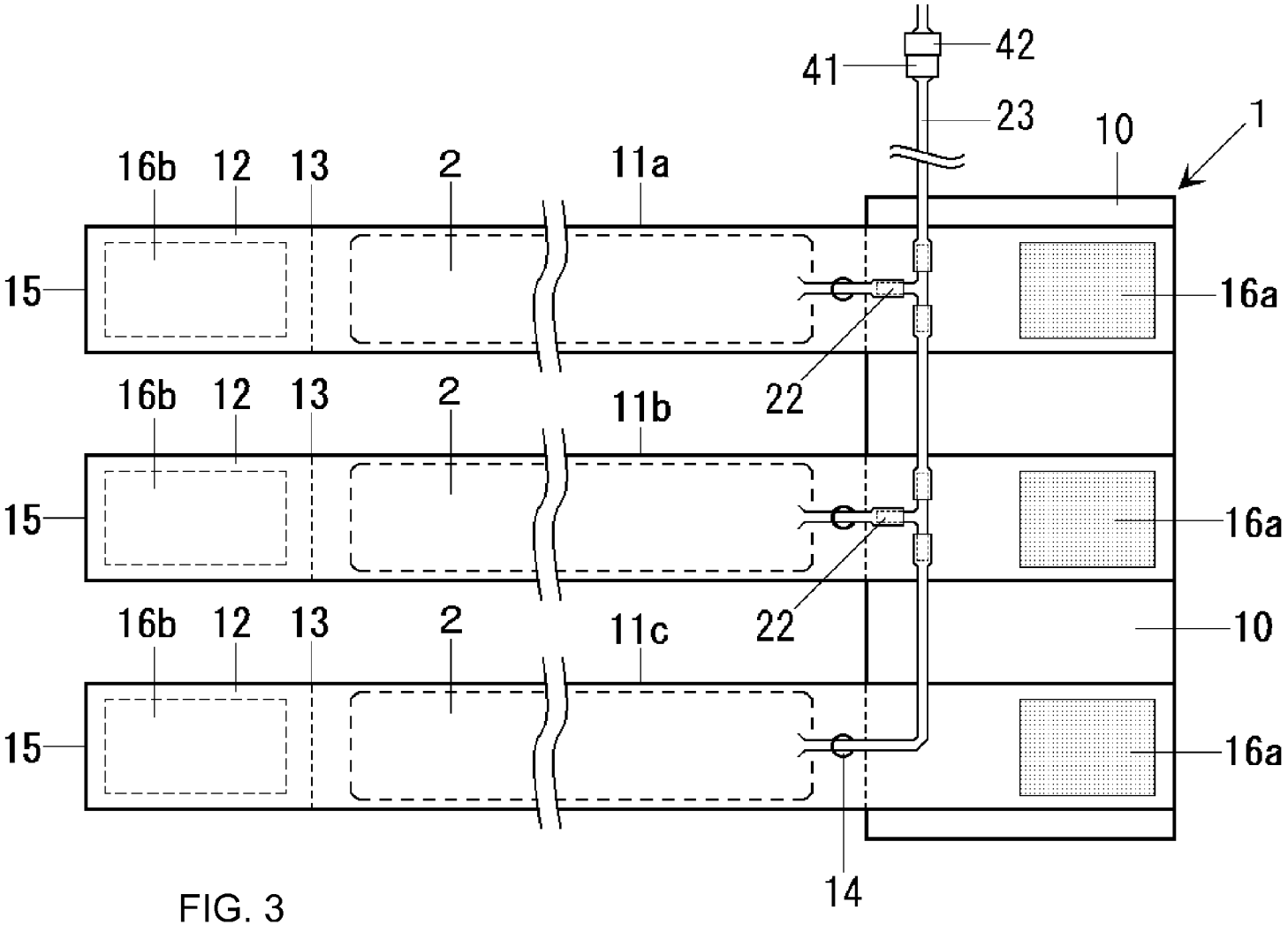
FIG. 3 is a plan view of the spread state of the plural parallel cuff of this invention.

As shown in FIG. 3, a thin tube 21 from the rubber bag 2 is led out of the small hole 14 of each of the cloth sleeve bags 11*a*, 11*b*, 11*c*. Then, the open end 15 of each of the cloth sleeve bags 11*a*, 11*b*, 11*c* is closed by sewing. Moreover, the seam 13 is formed by sewing along the line apart a little from the open end 15 of the cloth sleeve bag. Then, the flat part 12 is formed.

On the back of this flat part 12, a loop portion 16*b* of a hook-and-loop fastener, that is Velcro (Registered Trademark) fastener or Magic Tape (Registered Trademark), is attached. It is used for forming a loop cuff by bonding together the both ends of each of cloth sleeve bags 11*a*, 11*b*, 11*c*.

On the surface of the connection cloth 10, a hook portion 16*a* of the hook-and-loop fastener is attached. It is a counter part of the loop portion 16*b* attached on the back of the flat part 12 of the cloth sleeve bags 11*a*, 11*b*, 11*c*.

As shown in FIG. 3, the T-joint 22 is connected with the thin tubes 21 out of the small hole 14 of each of the three cloth sleeve bags 11*a*, 11*b*, 11*c*. Three rubber bags 2 are connected each other via the T-joints 22. One of the T-joints 22 is connected to a thin tube 23. The other end of the thin tube 23 is terminated with the plug 41 having a backflow valve.

Each of the cloth sleeve bags 11*a*, 11*b*, 11*c* with a rubber bag 2 forms a cuff. The connection cloth 10 connects three cuffs arranged in equal spaced intervals. The rubber bags 2 are connected to each other for air channel. Thus, plural parallel cuff 1 is formed.

Figure 4:
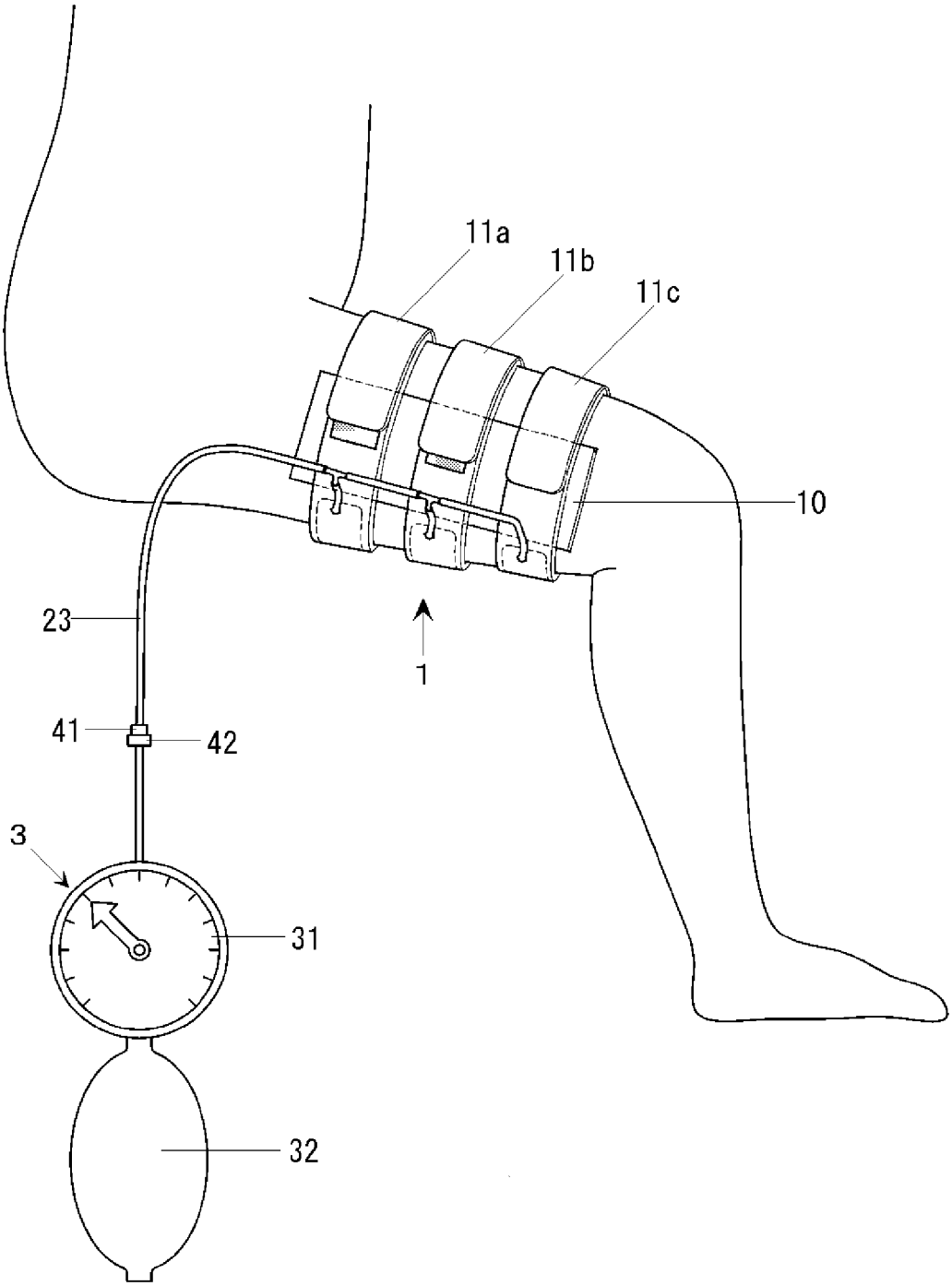
FIG. 4 is a perspective view of the first embodiment showing the state where the plural parallel cuff of this invention is wound around a thigh.

As shown in FIG. 4, plug 41 and socket 42 are utilized for connecting and disconnecting the pneumatic pump 3. Air is compressed into the rubber bags 2 via thin tube 23 and T-joints 22. After that, the plug 41 is disconnected from the socket 42 to remove the pneumatic pump 3. Then, a light exercise is performed. After the end of the light exercise, the plug 41 is reconnected to the socket 42 to release the air by opening the release valve (not shown) of the pneumatic pump 3.

The pneumatic pump 3 is composed of a pressure gauge 31, a rubber pumping ball 32 and a release valve (not shown). Compressed air is supplied to the rubber bags 2 by repeating the action of grasping and releasing the pumping ball 32 while the release valve is closed. The air pressure in the rubber bags 2 is shown on the pressure gauge 31.

The plural parallel cuff 1 as constituted above is used for winding around the upper arm or the thigh. The upper arm or the thigh is provided as a limb section. The center cuff of three cuffs connected by the connection cloth 10 is wound around the limb section first and it is fixed by a hook-and-loop fastener. And then, the outer cuffs are wound around the limb section and they are fixed by the hook-and-loop fasteners.

Thus, each cuff is wound around the limb section with very adequate length according to the diameter of the limb part to be wound. Each cuff is fixed by uniting the hook portion 16*a* to the loop portion 16*b*. Three cuffs are wound around the upper arm or the thigh with adequate strength.

And the plug 41 is connected to the socket 42 to compress air into the rubber bags 2 by the pneumatic pump 3. The jointed three rubber bags 2 can be filled with air compressed in equal pressure.

The inner circumference (skin-side part) and the outer circumference (outer part) of each of the cloth sleeve bags 11*a*, 11*b*, 11*c* is almost equal. Therefore, the outer circumference of the cloth sleeve bags 11*a*, 11*b*, 11*c* of untouched skin side cannot be extended and its length is restricted.

But, there is a margin in the length of the inner circumference of the cloth sleeve bags 11*a*, 11*b*, 11*c* of the skin side. Therefore, as shown in the cross section of FIG. 5, each of the pressurized three rubber bags 2 swells toward inner side. The cloth sleeve bags 11*a*, 11*b*, 11*c* bind tight and broad the upper arm or the thigh with uniform compression force.

In the plural parallel cuff 1 of this invention, the length of the rubber bags 2 is made shorter than that of the cloth sleeve bags 11*a*, 11*b*, 11*c*. Each of the cloth sleeve bags 11*a*, 11*b*, 11*c* can be formed to be a loop. Both ends of the pipes can be united by a pair of hook-and-loop fastener. The hook portion 16*a* is attached on the connection cloth 10 and the loop portion 16*b* is attached on the flat part 12.

Figure 6:
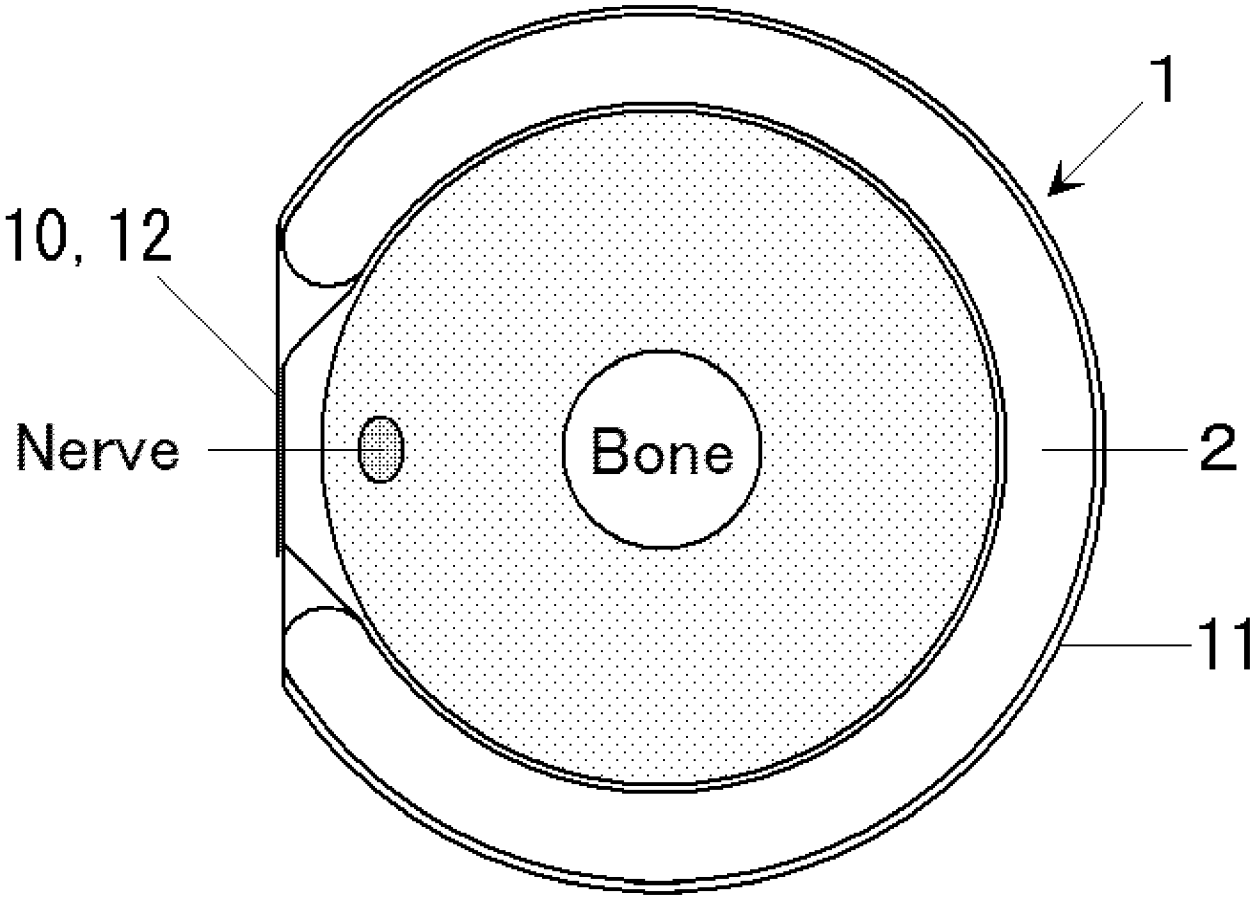
FIG. 6 is a sectional view of the principal part showing schematically the state where the plural parallel cuff of this invention is wound around a thigh or an upper arm.

In FIG. 6, the cross section of the upper arm or the thigh is schematically shown. When the plural parallel cuff 1 of this invention is wound on the upper arm or the thigh, there is partially formed a flat part 12 where exist only the connection cloth 10 and a cloth sleeve bag. No rubber bags 2 are there.

Then, the connection cloth 10 is adjusted to be placed at the position of the medial cutaneous nerve of the upper arm or the lateral femoral cutaneous nerve near the epidermis. In this way, the rubber bags 2 do not press the nerve near the epidermis.

The plural parallel cuff 1 is constituted as above. The bloodstream in muscles is restricted by the plural parallel cuff 1. The exercises are performed to reinforce the muscles of the upper arm or the thigh. But the nerve is not pressed. Then the trainee can continue the exercises without pain.

The Second Embodiment

When the inner pressure of the rubber bags 2 into the plural parallel cuff is initially set and arm curls or squats is executed, the cross section areas of fastening the plural parallel cuff to arm or thigh are changed large and small for the muscle compression forces. For example, because of the knot of biceps made by the arm curls.

Limb bending movement changes the cross-section area of the limb portion wound by the plural parallel cuff 1 in the training method using it. At that time, the rubber bags are compressed and loosened and their volume changes. Then the air pressure in the rubber bags goes up or descends and the upper arm or the thigh is fastened tight too much or loosened too much. Thus, the compression force is unsteady.

Then, the second embodiment of this invention is aimed to enable to reduce the fluctuation of the air pressure in the rubber bags caused by the bending and stretching exercise of the limbs.

Figure 5:
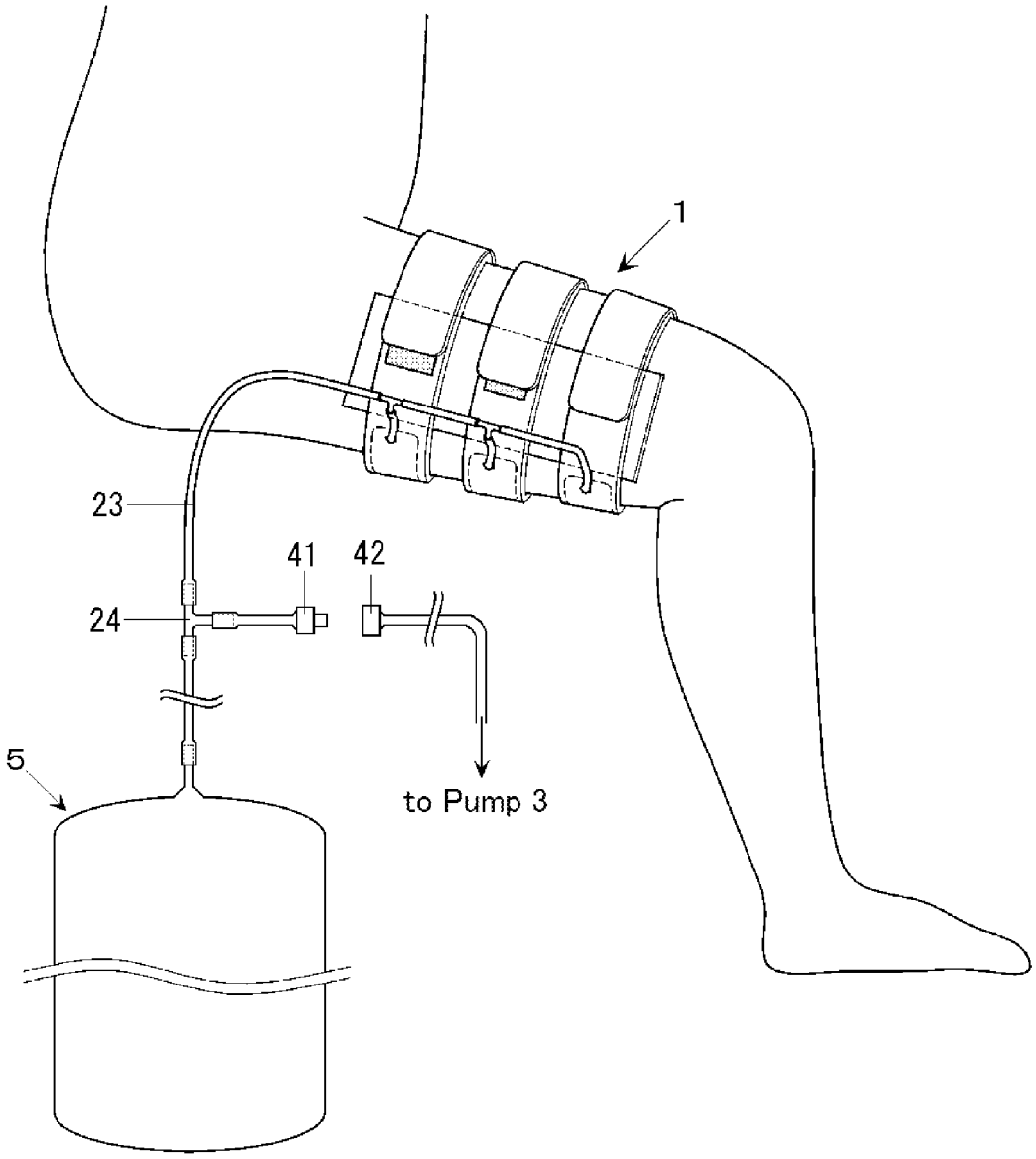
FIG. 5 is a perspective view of the second embodiment showing the state where the plural parallel cuff of this invention is wound around a thigh.

As shown in FIG. 5, besides the pneumatic pump 3, the surge tank 5 is connected to all the rubber tubes of the plural parallel cuff 1 through the T-joint 22 (see FIG. 3) and the thin tube 23. All the rubber tubes 2 and the surge tank 5 are always connected through the thin tube 21, the T-joint 22, the thin tube 23 and the T-joint 24.

The pneumatic pump 3 can be connected and disconnected with the plug 41 and the socket 42. When the pneumatic pump 3 is connected, air is compressed enough into the rubber bags and the surge tank 5 through the T-joint 24 and the thin tube 23. Then, the plug 41 of the pneumatic pump 3 is removed from the socket 42. The exercise is started. At the end of the training, the plug 41 is reconnected and the release valve (not shown) of the pneumatic pump 3 is turned open to release the air.

The surge tank 5 has a large volume compared to the rubber bags. It is furnished to equalize the pressure by absorbing the excess fluctuation of air pressure in the rubber bags. The surge tank 5 should preferably be lightweight, made of material and shape suitable for training.

Compressed air is supplied to the plural parallel cuff 1 while the pressure gauge is showing the pressure. The air pressure in the rubber bags and the surge tank 5 rises. The operation of the pumping ball is stopped when the air pressure reaches the suitable value corresponding to the compression force given to muscles. The plug 41 with backflow valve is removed from the socket 42 to separate the pneumatic pump 3. The training is started. At this time, the air in the rubber bags and the surge tank 5 does not leak out in training since the plug 41 is equipped with backflow valve.

It is supposed that a is the volume of the rubber bags kept at the suitable pressure p before the training, b is the volume of the surge tank 5, and Δ a is the volume reduction of the rubber bags while training.

It is supposed that, without the surge tank 5, the training is performed with the rubber bags only. Then, the air pressure P1 in the rubber bags becomes as follows.

$$P1=p\times a/(a-\Delta a)$$

The pressure P1 rises (P1>p) because of the volume reduction Δ a of the rubber bags.

But, the surge tank 5 with volume b much larger than the volume a (b>>a) of the rubber bags is connected to the plural parallel cuff 1 and it is kept at the adequate pressure p. Though the volume a of the rubber bags is reduced by Δ a while training, the air pressure P2 in the rubber bags and the surge tank 5 becomes as follows.

$$P2=p\times(a+b)/(a+b-\Delta a)$$

Thus, the increase of the air pressure P2 caused by the reduction of the volume of the rubber bags can be remarkably moderated.

Therefore, the plural parallel cuff 1 does not change its binding condition. Because the air pressure in the rubber bags hardly goes up for the surge tank although the rubber bags are compressed as those volume is decreased when the limb is bent and the muscle under the plural parallel cuff 1 becomes thick. Thus the muscles suffer no injuries and pains because of without increasing of the bag pressure. And also, the bloodstream in the muscles can be restricted enough because the binding force is kept steady condition.

The Third Embodiment

In the second embodiment as described above, the surge tank 5 is furnished near the body with the plural parallel cuff 1. But it may be furnished near the pump. And also, the surge tank 5 is not limited to the cylindrical shape. It is allowed to be flat.

Other Embodiments

In the above-mentioned embodiments, the connection cloth 10 fixes three cuffs in parallel at spaced intervals. The number of the cuffs can be determined as an optimal number according to the size of the limb portion for winding. And also, the connection cloth 10 is not restricted to be located at the edge of the cuffs. It can be located at the center of the cuffs. In this case, the flat parts are formed at both ends of each cuff. A pair of a hook portion 16*a* and a loop portion 16*b* of a hook-and-loop fastener can be attached to those flat parts.

REFERENCE NUMBERS

1 Plural parallel cuff
2 Rubber Bag
3 Pneumatic Pump
5 Surge Tank
10 Connection Cloth
11*a*, 11*b*, 11*c* Cloth sleeve bag
12 Flat Part
13 Seam
16*a* Hook Portion of Hook-and-Loop Fastener
16*b* Loop Portion of Hook-and-Loop Fastener
41 Plug
42 Socket

The invention claimed is:

1. A plural parallel cuff for pressurizing a limb portion for muscle training, comprising:

plural cloth sleeve bags having lengths and first and second ends distal from one another, a connection cloth for connecting said plural cloth sleeve bags with outer edges of said plural cloth bags separated from one another in parallel at spaced intervals, said connection cloth being substantially less than co-extensive with the lengths of the plural cloth sleeve bags, plural rubber bags shorter than said cloth sleeve bags inserted in said cloth sleeve bags respectively, hook-and-loop fasteners for forming loops by bonding said first and second ends of each of said cloth sleeve bags, and a plug for connecting detachably a pneumatic pump to said plural rubber bags.

2. A plural parallel cuff as described in claim 1, wherein furthermore a surge tank is set connected with said plural rubber bags channeling with each other, and the volume of said surge tank is made larger than the volume of said plural rubber bags.

3. A plural parallel cuff as described in claim 1, wherein said connection cloth connects said plural cloth sleeve bags at one of said first and second ends.

4. A plural parallel cuff as described in claim 1, wherein said connection cloth connects said plural cloth sleeve bags at a position centrally of said plural cloth sleeves.

5. A plural parallel cuff as described in claim 4, wherein flat portions are formed at said first and second ends for receiving said hook-and-loop fasteners.

6. A plural parallel cuff as described in claim 1, wherein the plural rubber bags are sufficiently shorter than said cloth sleeve bags such that when the plural parallel cuff is positioned on an arm or a leg of a user, the plural rubber bags do not press a nerve near the epidermis of the arm or the leg.

* * * * *